US006322073B1

(12) United States Patent
Davis

(10) Patent No.: US 6,322,073 B1
(45) Date of Patent: Nov. 27, 2001

(54) FOOTBALL BOARD GAME

(76) Inventor: Eugene A. Davis, 11218 W. Janesville Rd., Hales Corners, WI (US) 53130

( * ) Notice: Subject to any disclaimer, the term of this patent is extended or adjusted under 35 U.S.C. 154(b) by 0 days.

(21) Appl. No.: 09/592,824

(22) Filed: Jun. 13, 2000

Related U.S. Application Data

(63) Continuation-in-part of application No. 09/186,333, filed on Nov. 5, 1998, now abandoned.

(51) Int. Cl.[7] ..... A63F 3/00

(52) U.S. Cl. ..... 273/247; 273/236; 273/244; 273/259; 273/277

(58) Field of Search ..... 273/247, 287, 273/288, 236, 259, 277

(56) References Cited

U.S. PATENT DOCUMENTS 1,552,630 * 9/1925 Michaelian .
2,784,970 * 3/1957 Heiner .
2,933,316 * 4/1960 Mancini .
3,995,863 * 12/1976 Cummins .
4,094,509 * 6/1978 Barron .
4,773,650 * 9/1988 Doughty .
4,989,879 * 2/1991 Nigh .
5,158,301 * 10/1992 Martukovich .
5,186,461 * 2/1993 Tucker .

* cited by examiner

*Primary Examiner*—Benjamin H. Layno
*Assistant Examiner*—V K Mendiratta

(57) ABSTRACT

A football board game is disclosed. The board game includes a board formed in a rectangular configuration of two essentially square halves pivotably coupled together at a fold line. A playing surface has a central indicia with separate words on each side of the fold line, end zones at the opposite ends parallel with the center fold line with elongated margins between the end zones. Each margin has interiorly, a plurality of apertures for receipt of objects, indicia indicating yardage adjacent the edges thereof and arrows in opposite directions located between the apertures and the yard markers. A pair of pegs are positioned in the apertures, one peg having a cube with "down marker" indicia on each vertical face and the other having a football constituting a ball position marker. The game includes a plurality of decks of similarly configured playing cards, each deck having similar indicia on one side and a different color on the other side and positioned at opposite ends of the board. A pad of score cards indicates across the top: quarter, dealer, contestant one, contestant two; and down one side under the quarter designation: one, two, half, score, three, four, and final scores. Also included is a book of rules with a table of contents and a ready reference section.

2 Claims, 2 Drawing Sheets

FOOTBALL BOARD GAME

RELATED APPLICATION

This application is a continuation-in-part of application Ser. No. 09/186,333 filed Nov. 5, 1998, now abandoned, Applicant Eugene A. Davis, entitled "Football Board Game".

BACKGROUND OF THE INVENTION

1. Field of the Invention

The present invention relates to a football board game and more particularly pertains to providing a game t simulate a real football game.

2. Description of the Prior Art

The use of board games of known designs and configurations is known in the prior art. More specifically, board games of known designs and configurations previously devised and utilized for the purpose of playing games on boards through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number or board games of known designs and configurations. By way of example, U.S. Pat. No. 5,186,461 to Tucker issued Feb. 16, 1993, discloses a simulated football board game. U.S. Pat. No. 5,158,301 to Martukovich, Jr., issued Oct. 27, 1992, discloses a football board game. U.S. Pat. No. 4,183,529, to Hynson, issued Jan. 15, 1980, discloses a football game. U.S. Pat. No. 3,103,361 to Board issued Sep. 10, 1963, discloses a football game with play selecting cards. U.S. Pat. No. 1,701,655 to Andrews, issued Feb. 12, 1920, discloses a table football game. Foreign patents EP 0 205 690 A1 to Caughie et al, issue/priority date Jun. 17, 1985, discloses a football game board, and WO 91/00,786 to Nugent et al, issue/priority date Jan. 23, 1992, discloses an apparatus for playing a board game.

In this respect, the football board game according to the present invention substantially departs from the conventional concepts and designs of the prior art, and in doing so provides an apparatus primarily developed for the purpose of providing a game t simulate a real football game.

Therefore, it can be appreciated that there exists a continuing need for a new and improved football board game which can be used for providing a game t simulate a real football game. In this regard, the present invention substantially fulfills this need.

SUMMARY OF THE INVENTION

In view of the foregoing disadvantages inherent in the known types of board games of known designs and configurations now present in the prior art, the present invention provides an improved football board game. As such, the general purpose of the present invention, which will be described subsequently in greater detail, is to provide a new and improved football board game and method which has all the advantages of the prior art and none of the disadvantages.

To attain this, the present invention essentially comprises a football board game. The board game includes a board formed in a rectangular configuration of two essentially square halves pivotably coupled together at a fold line. A playing surface has a central indicia with separate words on each side of the fold line, end zones at the opposite ends parallel with the center fold line with elongated margins between the end zones. Each margin has interiorly, a plurality of apertures for receipt of objects, indicia indicating yardage adjacent the edges thereof and arrows in opposite directions located between the apertures and the yard markers. A pair of pegs are positioned in the apertures, one peg having a cube with "down marker" indicia on each vertical face and the other having a football constituting a ball position marker. The game includes a plurality of decks of similarly configured playing cards, each deck having similar indicia on one side and a different color on the other side and positioned at opposite ends of the board. A pad of score cards indicates across the top: quarter, dealer, contestant one, contestant two; and down one side under the quarter designation: one, two, half, score, three, four, and final scores. A contestant may be an individual or a team having two or more individuals. Also included is a book of rules for the game. The rules include placing the game board on a flat surface such as a table between the contestants, playing wherein the offensive contestant now leading a card and taking the trick gains the number of yards corresponding to that cards yardage value, if the offensive contestant partner takes the trick he will lead the next trick, if the defensive contestant takes the trick, the offensive contestant loses the number of yards or difference between the highest offensive contestant card and the card value that takes the trick, plus loss of down, if the defensive contestant takes a trick with a face card and causes a loss of ten or more yards, it becomes a fumble in which case, the correct calling of the color of a picked card determines which contestant recovers with the recovering contestant becoming the offensive contestant.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved football board game which has all of the advantages of the prior art board games of known designs and configurations and none of the disadvantages.

It is another object of the present invention to provide a new and improved football board game which may be easily and efficiently manufactured and marketed.

It is further object of the present invention to provide a new and improved football board game which is of durable and reliable construction.

An even further object of the present invention is to provide a new and improved football board game which is susceptible of a low cost of manufacture with regard to both materials and labor, and which accordingly is then susceptible of low prices of sale to the consuming public, thereby making such football board game economically available to the buying public.

Even still another object of the present invention is to provide a football board game for providing a game to simulate a real football game.

Lastly, it is an object of the present invention to provide a football board game. The board game includes a board formed in a rectangular configuration of two essentially square halves pivotably coupled together at a fold line. A playing surface has a central indicia with separate words on each side of the fold line, end zones at the opposite ends parallel with the center fold line with elongated margins between the end zones. Each margin has interiorly, a plurality of apertures for receipt of objects, indicia indicating yardage adjacent the edges thereof and arrows in opposite directions located between the apertures and the yard markers. A pair of pegs are positioned in the apertures, one peg having a cube with "down marker" indicia on each vertical face and the other having a football constituting a ball position marker. The game includes a plurality of decks of similarly configured playing cards, each deck having similar indicia on one side and a different color on the other side and positioned at opposite ends of the board. A pad of score cards indicates across the top: quarter, dealer, contestant one, contestant two; and down one side under the quarter designation: one, two, half, score, three, four, and final scores. A contestant may be an individual or a team having two or more individuals. Also included is a book of rules with a table of contents and a ready reference section. The rules for the game constitute placing the game board on a flat surface such as a table between the contestants. The Rules include playing wherein the offensive contestant now leading a card and taking the trick gains the number of yards corresponding to that cards yardage value, if the offensive contestant partner takes the trick he will lead the next trick, if the defensive contestant takes the trick, the offensive contestant loses the number of yards or difference between the highest offensive contestant card and the card value that takes the trick, plus loss of down, if the defensive contestant takes a trick with a face card and causes a loss of ten or more yards, it becomes a fumble in which case, the correct calling of the color of a picked card determines which contestant recovers with the recovering contestant becoming the offensive contestant.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
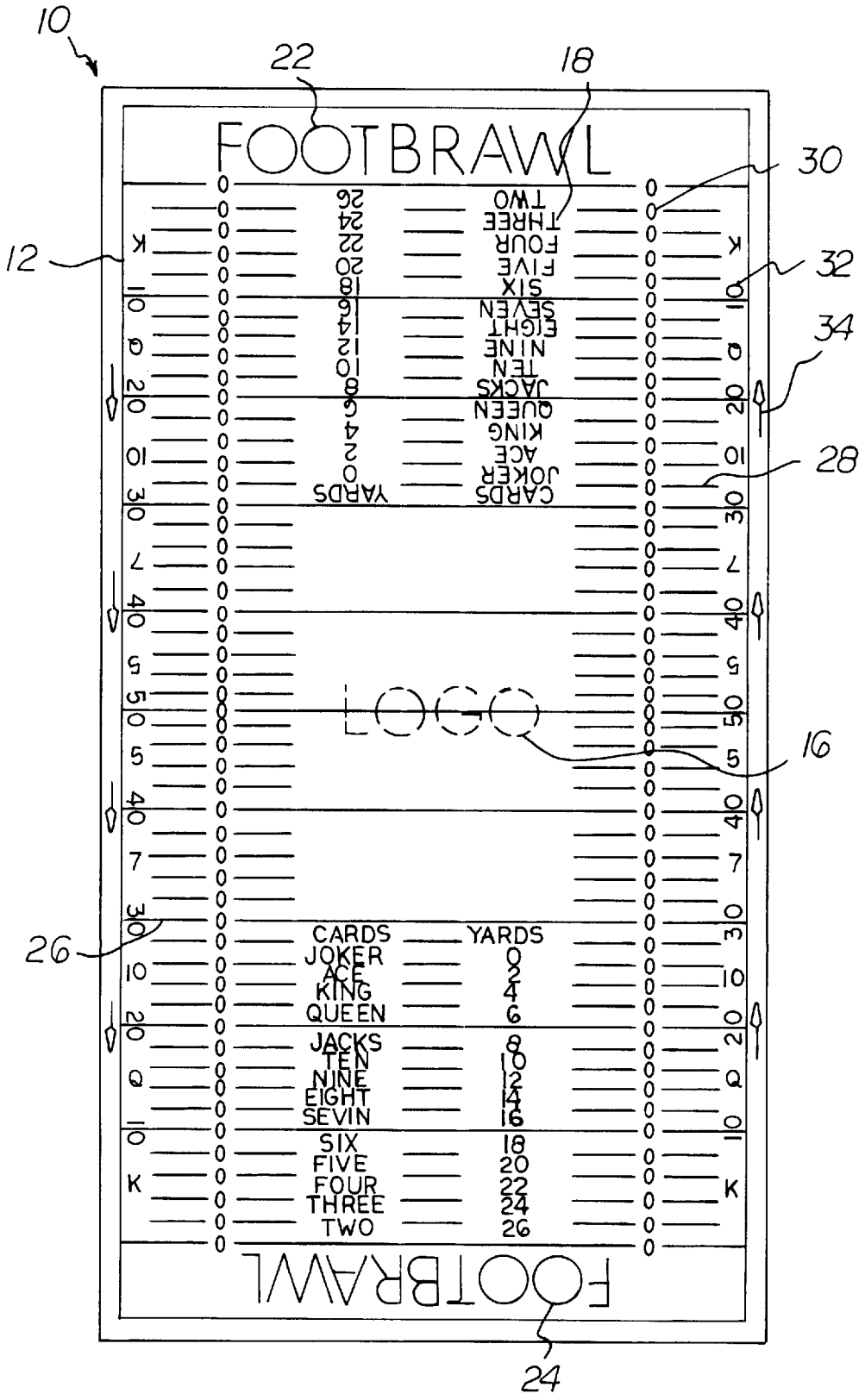
FIG. 1 is a top elevational view of the board utilized in association with the present invention.

With reference now to the drawings, and in particular to FIGS. 1 through 5 thereof, the preferred embodiment of the football board game embodying the principles and concepts of the present invention and generally designated by the reference numeral 10 will be described.

The present invention, the football board game 10 is comprised of a plurality of components. Such components in their broadest context include a board, pegs, playing cards, score cars, and a book of rules. Each of the individual components are individually configured and correlated with respect to each other so as to attain the desired objective.

More specifically, it will be noted that the system 10 of the present invention includes a board 12 formed in a rectangular configuration of two essentially square halves pivotally coupled together. The board has a playing surface with central indicia therein 16. The playing surface also has indicia 18 indicating yard values for the various cards. End zones 22, 24 are located at the opposite ends parallel with the center fold line. Elongated margins 26, 28 are located between the end zones. Each margin has interiorly, a plurality of apertures 30 for receipt of objects, indicia 32 indicating yardage adjacent the edges thereof and arrows 34 in opposite directions between the apertures and the yard markers.

Figure 2:
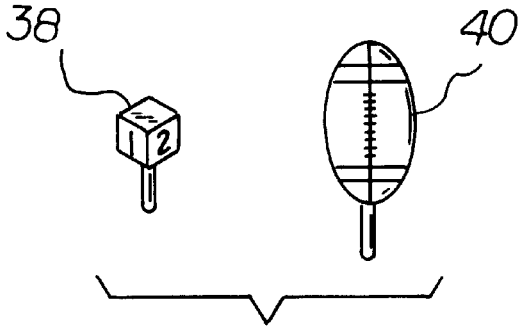
FIG. 2 is a perspective view of a down marker and ball position marker for use on the board of FIG. 1.
Figure 3:
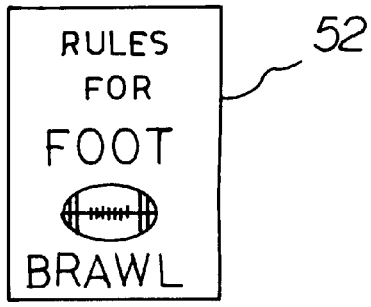
FIG. 3 is a rule book for use in association with the board game of FIG. 1.
Figure 4:
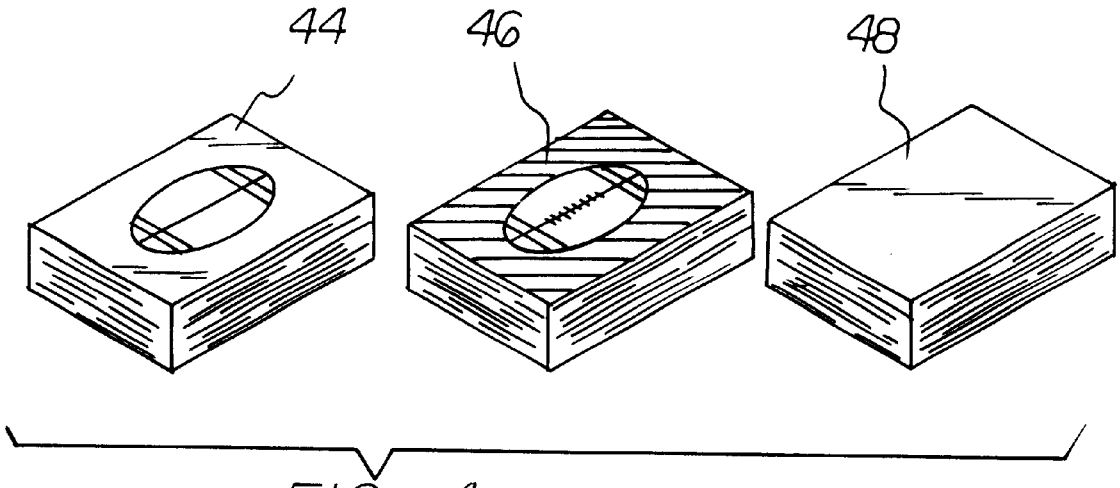
FIG. 4 is a pair of decks of cards for use in association with the board game of FIG. 1.
Figure 5:
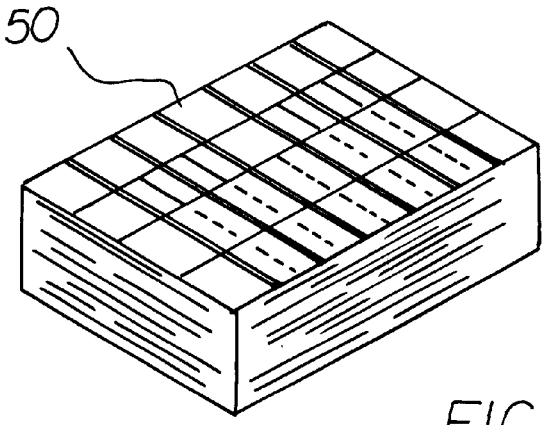
FIG. 5 is a perspective view of a scorecard for use in association with the board game of the present invention.

As shown in FIG. 2, a pair of pegs 38, 40 is provided. The pegs are positioned in the apertures, one peg having a cubge with "down marker" indicia on each vertical face and the other having a football constituting a ball position marker.

Also included are two decks 44, 46 of playing cards, each card having indicia thereon and a supplemental deck 48, a drawing deck.

Next provided is a pad 50 of score cards indicating across the top: quarter, dealer, team one, team two; and down one side under the quarter designation: one, two, half, score, three, four and final scores.

Further provided is a book of rules 52 for the game as described herein below:

"FOOTBRAWL"

DESCRIPTION AND COMPONENTS

FOOTBRAWL is a board game emulating a real game of FOOTBALL. It consists of a game board, a ball marker, a "down" marker, three decks of regular playing cards, a score pad and a rule book/instruction pad. Two decks for playing will contain four JOKERS in each deck. The third deck will be a drawing deck and will contain two JOKERS.

BLACK CARDS are running plays.

RED CARDS are passing plays.

PLAYING THE GAME

1. Place the game board on the table between the contestants. The two contestants may be two individuals or two teams with each team including two or more individuals. The tricks are played on the game board. Each of the contestants will select a deck to use for their team throughout the game.

2. The "coin toss." One contestant will draw a card from the drawing deck and by calling the correct color will choose to begin the game on either offense or defense.

3. The contestant going on offense will receive the kick-off from the opponent's 40-yard-line (See #15). Mark the board with the ball marker at the end of the kick.

4. If returnable, (See #15) they will return the kickoff (See #16). Mark the end of the return, or "fair catch", with the ball marker. Place the "down" marker 10 yards beyond the ball marker with the "down" number facing the center of the field. This is where the offense will start play.

5. Both contestants will now deal out fourteen cards to themselves. Place the remaining cards back in the box so they will not become mixed with the other cards. They will be used for future deals. Each hand counts as one quarter of the game. Mark the score pad, even if zero, to keep track of the quarter. Also mark who received the opening kickoff as the other contestant will go on offense beginning the second half of the game.

6. The offense will now lead a card. If they take the trick they will gain the yardage value of the car taking the trick. Adjust the "down" marker after each play by facing it toward the center of the field. The offense has four "downs" to gain 10 or more yards or they must turn the ball over or punt the ball away. (See #15). All tricks are "suit" tricks.

7. If the defense takes the trick, the offense will lose the number of yards DIFFERENCE between the two cards in yard value. This would also be a loss of down.

If the defense takes the trick with a FACE CARD and causes a loss of 10 OR MORE YARDS it becomes a "SACK" and a fumble in the backfield. In this case, the defense will draw one card and by calling the correct color they will recover the fumble. If a JOKER is drawn, they lose the draw.

A fumble recovered in the end zone by a SACK is a touch down. Being forced back into the end zone without it being a SACK is a SAFETY worth two points for the defense. The contestant scoring the safety would also receive the ensuing kickoff.

JOKERS CANNOT cause any loss of yards. They only cause a loss of down. (See #19).

8. The offense may elect to punt on ANY down. (See #15). They may try a field goal on any down also, providing they are inside their 50-yard-line and still have a down remaining. (See #13). If a field goal is missed, the other contestant takes over PLUS 10 yards. (See #11) for half time and end of game.

9. When the offense reaches the end zone, they score a touchdown worth 6 points. (See #14 for extra points). After a contestant has successfully scored, repeat the kick-off procedure. (See #15). Always continue playing with the cards remaining in your hand as this is the time clock for the game.

10. Option Plays for the Offense

On all FIVES, FOURS, THREES and TWOS, you may elect to try the option play instead of taking the yardage from the table. These can be risky but also may result in huge plays.

The Five and Fours

Tricks taken with FIVES and FOURS may pass up the table yardage and draw three cards instead. Add up the yardage of all of the cards of the same color as the card that took the trick. The other color cards do not count. STRAIGHTS and FLUSHES containing only the color of the play are TOUCHDOWN plays. ACES only count as high in STRAIGHTS.

Drawing a JOKER on the draw becomes a no gain and a loss of down situation.

The Threes and Twos

These are the real big gainers but they also come with added risk. Again, pass the table yardage and draw three cards. Add up the yardage of all three cards of BOTH COLORS. This would be your gain, unless . . .

If you should draw a JOKER on the draw, it would indicate either an INTERCEPTION or a RECOVERED FUMBLE at the end of the gain. (Drawing a JOKER ends the draw).

Interceptions and fumbles recovered are both returnable in the same manner as above. Add up the yardage of all three cards for your return.

If a JOKER is drawn on the return, this becomes a fumble recovered back to the offensive contestant. If the offensive contestant recovered the ball beyond their down marker, they would gain a new set of downs. However, if on fourth down and they would recover the fumble but short of their down marker they would still lose possession to the other contestant on downs.

If either contestant should draw any FLUSH, STRAIGHT, or THREE OF A KIND, they would score a touchdown.

Drawing a JOKER ends the draw for either contestant.

11. Half-Time and End of Game

Approaching half-time and end of game, the offense may attempt a field goal AFTER they have played their last card providing they are within the 50-yard-line and have a down remaining. The contestant beginning the game on offense will begin the second half on defense.

Tied games are extended by one quarter of whichever contestant scores first in the overtime period.

12. Card Values and Yard Values

| CARD VALUES | YARD VALUES |
|---|---|
| JOKERS | 0 Yards |
| ACE | 2 Yards |
| KING | 4 Yards |
| QUEEN | 6 Yards |
| JACK | 8 Yards |
| TEN | 10 Yards |
| NINE | 12 Yards |
| EIGHT | 14 Yards |
| SEVEN | 16 Yards |
| SIX | 18 Yards |
| FIVE | 20 Yards or Option |
| FOUR | 22 Yards or Option |
| THREE | 24 Yards or Option |
| TWO | 26 Yards or Option |

13. Field Goals: Aces are High

Field goals are worth three points. To make a field goal, draw a card from the draw deck. Drawing a JOKER is a 10-yard penalty, replay the down.

0–10 yards must turn up a KING or under

11–20 yards must turn up a QUEEN or under

21–30 yards must turn up a TEN or under

31–40 yards must turn up a SEVEN or under

41–50 yards must turn up a FIVE or under (field goal indicia is on the game board.)

14. Extra Points (P.A.T.s)

Must turn up a KING or under. For a two-point conversion, you must also call the correct color. Drawing a JOKER is a 10-yard penalty, replay the down. Must now draw QUEEN or under.

15. Kick-Offs and Punts

All kick-offs are made from the 40-yard line. Punts are made from the line of scrimmage. Draw three cards from the draw deck. Add the yard values of all three cards for your distance.

If any ACE is drawn, the kick cannot be returned, (EXCEPTION) unless the kick goes into the end zone. (See #16.) In all other scenarios, it would become a "fair catch" by the receiving contestant at the end of the kick.

Drawing a JOKER on a kick, is for "0" yards, (which is the penalty as it counts a sone of the three cards drawn). These kicks may be returned, unless they contain an ACE.

16. Returning Kick-Offs and Punts

Draw three cards and ADD the yard values of all of the RED CARDS, DEDUCT the yard values of all of the BLACK FACE CARDS. The other black cards do not count. FLUSHES AND STRAIGHTS are touchdown returns providing they are made up of only RED cards.

Drawing a JOKER on the return ends the draw and becomes a 10-yard-penalty from the end of the kick. If the penalty would put the ball in the end zone, it would be place don the two-yard line. If a LOSS on the return puts you in the end zone, it becomes a SAFETY and two points for the other contestant.

The receiving contestant may attempt to return any kick going into the end zone, or they may elect to take over at the 20-yard line (touchback).

17. On-Side Kicks

To regain possession of the ball after scoring, a contestant may attempt an ON-SIDE KICK. To do this, they must draw a card and it must be anything but a face card. This indicates that the ball has gone the required 10 yards (from the 40-yard line). Now the other contestant must draw a card, also anything but a face card to recover the kick. If the kicking contestant wins both of the draws, they successfully recover the ball. Whichever of the contestants recovers will take over at the 50-yard line. If a contestant draws a JOKER, they lose the draw.

18. Referee Calls and Penalties

Failure to follow suit (reneging), dealing yourself the wrong number of cards or any other infractions that come up during the course of a game are 10-yard penalties. In case of a dispute, draw a card from the draw deck and by calling a color let the Referee decide who wins the draw. Penalties may be decline din a friendly atmosphere. If they are invokes, it is at the time of discovery. If a penalty would put you in the end zone, the ball would be spotted at the two-yard line. You cannot score on a penalty.

19. Jokers and Their Use

JOKERS and wild cards can be played at any time either on offense or defense. They have no yardage value for either contestant and cause only a loss of down.

On DEFENSE the JOKERS can nullify any card of any suit, when played, for a loss of down. They cannot cause "sacks" or fumbles.

On OFFENSE the JOKERS may be used as BLOCKERS to open up a suit for the big gainers. When lead, they may call for a specific suit to be played. If you have no cards of that suit, you may slough any card you wish. If you DO have that suit, you must follow suit or play a JOKER in lieu of that suit and keep the suit card for a later "SACK" or fumble.

Until the JOKERS are accounted for, they can be very intimidating especially, on fourth down situations.

20. Playing Hints

*By stacking the tricks taken, neatly in a pile, they can be referred back to in case instant replay becomes necessary.

*Try to maintain a positive attitude.

*Remember the cards your OPPONENT plays as well as you can.

*Use discretion when gambling. Consider the odds.

*Try to coach as though you were in the PRO's. Be Smart.

*Never give up. It is possible to rally.

*Try two hands per quarter for a REAL BRAWL.

The present invention is a board game that simulates a real game of football. The game set includes a playing board the represents a football field, two decks of playing cards which are similar to regular pocker decks without the jokers; a ball position marker, a down marker, a pad of score sheets and a rule book. Contestants attempt to win "tricks" to move the ball, gaining, or losing, the number of yards indicated by the rule book. The lower card that takes the trick, the more yards are gained. The high cards have the defensive value of taking tricks resulting in losses or even turnover. On offense the high cards are blockers that are used to open up a suit for the big gainers. The strategy is not to merely take the most tricks, but to take them at the right time to prevent first downs by the offense and to create turnovers, and vice versa. The basic game, however, is easy to learn for contestants aged approximately 10 years old and up.

The present invention provides many benefits. Exciting and challenging, contestants can employ strategy to make the best of their luck of the draw. The game can be adapted to tournament play on a competitive level, perhaps with friendly wagering. It is also excellent for casual play, and provides a quality pastime to promote family togetherness. Football fans of all ages will enjoy their chance to get on the team. The game is also an excellent teaching tool for young people to learn how football is played. Finally, the present invention is a perfect product to add to an NFL licensed merchandise line.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved football board game method that simulates a real football game comprising, in combination:

providing a board formed in a rectangular configuration of two essentially square halves pivotably coupled together, the board having a playing surface with a central circle and indicia therein and having end zones at the opposite ends parallel with the center fold line and with elongated margins there between, each margin having interiorly, a plurality of apertures for receipt of objects, indicia indicating yardage adjacent the edges thereof, and arrows in opposite directions between the apertures and the yard markers;

providing a pair of pegs positioned in the apertures, one peg having a cube with "down marker" indicia on each vertical face and the other having a football constituting a ball position marker;

providing a plurality of decks of playing cards, each deck having similar indicia thereon but differently colored backs;

providing a pad of score cards indicating across the top, quarter, dealer, team one, team two and down one side under the quarter designation, one, two, half, score, three, four, and final scores;

providing a book of rules for the game constituting placing the game board on a flat surface such as a table between a first contestant and a second contestant, one contestant selecting a card from an associated deck and calling the correct color electing to begin the game as either the offensive contestant or the defensive contestant, the offensive contestant receiving the kick-off from the defensive contestant's 40 yard line and marking the board with the ball marker thereat, the offensive contestant returning the kick-off by placing the down marker 10 yards beyond the ball marker thereby marking where the offensive contestant will begin, each of the contestants dealing themselves cards with fourteen cards going to each contestant, noting that for two contestants after dealing, there will be three-fourths of the deck remaining and placing the remaining cards back into the box so they will not become mixed with the other cards and using these cards for the next deal, marking the score sheet with the dealer and progressing clockwise for future deals, and being sure to mark the score sheet after each hand even if it is zero to keep track of the quarters with one deal constituting one quarter with each game lasting for four quarters or a plurality of hands, the offensive contestant now leading a card and taking a trick gaining the number of yards corresponding to the yardage value of the that card, if the offensive contestant takes the trick, he will lead the next trick, if the defensive contestant takes the trick, the offensive contestant loses the number of yards or difference between the highest offensive contestant card and the card value that takes the trick, plus loss of down, if the defensive contestant takes a trick with a face card and causes a loss of ten or more yards, it becomes a fumble in which case, the correct calling of the color of a picked card determines which contestant recovers with the recovering contestant becoming the offensive contestant, a fumble recovered in the end zone is a touchdown, if the offensive contestant is forced back into their end zone it is a safety worth two points with the contestant causing the safety receiving the ensuing kick-off, the offensive contestant being allowed to punt on any down and attempt a field goal on any down providing they are within the 50 yard limit, if missing a field goal, however, the defense taking over plus ten yards, when the offensive contestant reaches the end zone, scoring a touchdown worth six points and after scoring a touchdown or a field goal, repeating the kick-off procedure, always continuing play with the cards left in the contestant's hand as being the time remaining in the game and, after using all the cards, redealing and continuing the game and marking the score sheet after each hand to keep track of the quarters, and when playing with four contestants for big plays (5's, 4's, 3's, 2's) lead by the offensive contestant and taking the trick for either the cards yardage value or option play yardage, approaching half time or the end of the game, the offensive contestant may attempt a field goal after the have played their last card, providing they are within the 50 yard line and have a down remaining, the contestant beginning on offense beginning the second half on defense, and in case of a tie, the game being extended by one quarter or whichever contestant scores first, field goals being scored with aces being high and worth three points, extra points achieved by turning up a king or under for two point conversions the color also being called, kick-offs being made from the 40 yard line and punts being made from the position of the offense at the time of the punt, and adding the yard values of the three cards for distance with the exception of flushes, straights and three of a kind being touchbacks into the end zone and being returnable or taken on the 20 yard line, returning kick-offs and punts made by drawing three cards from deck two and adding the yard values of all of the red cards and deducting the yard values of all the black face cards and all other black cards having a zero value with the result being the return, with the exception that flushes and straights (red cards only) as being runbacks for touchdowns, and penalties being unscorable by failing to follow suit when possible and playing out of turn and other infractions a contestant objects to resulting in a 10 yard penalty, or one half the distance to the goal line, with penalties being declinable and referable to a referee by drawing a card and calling the correct color to see how he has ruled; an optional choice for play wherein the time required to play the game is reduced to less than an hour by choosing to deal only once per quarter instead of twice; and an added option for the rules whereby after scoring, a contestant trailing may elect to try an on-side kick to retain possession of the ball, the kicking contestant drawing one card from deck #2, said card being anything but a face card, said non-face card indicating the kick has traveled the required 10 yards, following which the defense draws a card, said card being anything but a face card, said draw determining which contestant has recovered the on-side kick whereby if the kicking contestant fails to win both of the draws the other contestant takes over play, whereby the contestant winning the draw takes over at the 50 yard line, and the chances for a successful on-side kick is about 50 percent.

2. A football board game method that simulates a real football game comprising:

providing a board formed in a rectangular configuration of two essentially square halves pivotably coupled together at a fold line, the board having a playing surface with a central indicia therein with separate words on each side of the fold line and having end zones at the opposite ends parallel with the center fold line and with elongated margins there between, each margin having interiorly, a plurality of apertures for receipt of objects, indicia indicating yardage adjacent the edges thereof and arrows in opposite directions located between the apertures and the yard markers;

providing a pair of pegs positioned in the apertures, one peg having a cube with "down marker" indicia on each vertical face and the other having a football constituting a ball position marker;

providing a plurality of decks of similarly configured playing cards, each deck having similar indicia on one side and a different color on the other side and positioned at opposite ends of the board;

providing a pad of score cards indicating across the top, quarter, dealer, contestant one, contestant two and down one side under the quarter designation, one, two, half, score, three, four, and final scores;

providing a book of rules for the game constituting placing the game board on a flat surface such as a table between the contestants and, playing wherein the offensive contestant now leading a card and taking a trick gains the number of yards corresponds to the value of the card taking the trick, if the offensive contestant partner takes the trick he will lead the next trick, if the defensive contestant takes the trick, the offensive contestant loses the number of yards or difference between the highest offensive contestant card and the card value that takes the trick, plus loss of down, if the defensive contestant takes a trick with a face card and causes a loss of ten or more yards, it becomes a fumble in which case, the correct calling of the color of a picked card determines which contestant recovers with the recovering contestant becoming the offensive contestant.

* * * * *